US007347878B2

(12) United States Patent
Soares et al.

(10) Patent No.: US 7,347,878 B2
(45) Date of Patent: Mar. 25, 2008

(54) METHOD OF ACHIEVING A PERMANENT "STONE-WASH" EFFECT ON TEXTILE FIBRE MATERIALS

(75) Inventors: Pedro Daniel Soares, Natal (BR); Peter Scheibli, Binningen (CH)

(73) Assignee: Huntsman International LLC, The Woodlands, TX (US)

( * ) Notice: Subject to any disclaimer, the term of this patent is extended or adjusted under 35 U.S.C. 154(b) by 0 days.

(21) Appl. No.: 10/534,514

(22) PCT Filed: Nov. 6, 2003

(86) PCT No.: PCT/EP03/12387

§ 371 (c)(1),
(2), (4) Date: May 11, 2005

(87) PCT Pub. No.: WO2004/046454

PCT Pub. Date: Jun. 3, 2004

(65) Prior Publication Data

US 2006/0179581 A1 Aug. 17, 2006

(30) Foreign Application Priority Data

Nov. 15, 2002 (EP) ..... 02405986

(51) Int. Cl.
*D06L 3/00* (2006.01)
*D06L 3/11* (2006.01)

(52) U.S. Cl. ..... 8/102; 8/107; 8/138; 8/401; 8/485; 8/636; 435/263; 252/8.61

(58) Field of Classification Search ..... 8/115.51, 8/401, 441, 102, 107, 138, 485, 636; 435/263; 252/8.61
See application file for complete search history.

(56) References Cited

U.S. PATENT DOCUMENTS

| | | | | |
|---|---|---|---|---|
| 3,043,645 | A * | 7/1962 | Womble | 8/505 |
| 4,351,638 | A * | 9/1982 | Finlayson et al. | 8/463 |
| 5,006,126 | A | 4/1991 | Olson et al. | 8/401 |
| 5,350,423 | A | 9/1994 | Davis, Jr. et al. | 8/401 |
| 5,460,966 | A * | 10/1995 | Dixon | 435/263 |
| 5,565,006 | A | 10/1996 | Videbaek et al. | 8/102 |
| 5,667,530 | A * | 9/1997 | Benasra | 8/102 |
| 5,690,694 | A | 11/1997 | Kang | 8/102 |
| 5,914,443 | A | 6/1999 | Kalum | 8/401 |
| 5,925,148 | A * | 7/1999 | Barfoed et al. | 8/401 |
| 5,958,082 | A * | 9/1999 | Lund et al. | 8/102 |
| 6,261,828 | B1 | 7/2001 | Lund | 435/263 |

FOREIGN PATENT DOCUMENTS

| | | |
|---|---|---|
| DE | 4038488 | 6/1992 |
| EP | 0362729 | 4/1990 |
| EP | 0843041 | 5/1998 |
| GB | 838339 | 6/1960 |
| GB | 1496810 | 1/1978 |
| WO | 94/06962 | 3/1994 |
| WO | 01/57173 | 8/2001 |

OTHER PUBLICATIONS

Derwent Abstr. 90-109113/15 for EP 0362729 (1990).
Dr. Hans Herzog, Melliand, vol. 43, No. 8, (1962), pp. 848-849.
Chem. Abstr. 1962:476992 for H. Herzog, Melliand, vol. 43, No. 8, (1962), pp. 848-849.
Derwent Abstr. 2001-616074/71 for WO 01/57173 (2001).
Derwent Abstr. 92-193158/24 for DE 4038488 (1992).

* cited by examiner

*Primary Examiner*—Lorna M. Douyon
*Assistant Examiner*—Tri Nguyen

(57) ABSTRACT

A method of achieving a permanent stone-wash effect on textile fiber materials, in which method the textile fiber materials are dyed with naphthol dyes and the dyed textile material is then after-treated with a stone-wash finish. Very fast dyeings having a permanent stone-wash finish are obtained.

6 Claims, No Drawings

METHOD OF ACHIEVING A PERMANENT "STONE-WASH" EFFECT ON TEXTILE FIBRE MATERIALS

The present invention relates to a method of achieving a permanent stone-wash effect or "washed-out look" or "used look" on textile fibre materials, especially cellulosic fibre materials, dyed with naphthol dyes.

In order to impart the "washed-out look" or "used look" to the textile fibre materials, the corresponding textile fibre materials, especially cotton fabrics, which have generally been dyed with indigo dyes, are subjected to bleaching, and a so-called "stone wash" process is carried out in which, for example, pumice stones, pebbles or sand are traditionally used. A more recent method of achieving the "washed-out look" or "used look" is distinguished by the use of cellulases (enzymes). In that method, the dyed textile fabric, e.g. jeans, is desized and then treated with cellulase. The advantage of the enzymatic method is that bleaching and the use of, for example, pumice stone are unnecessary.

A major disadvantage of the procedures described above is that the effect cannot be maintained over a prolonged period because of bleeding, or washing out, and rubbing abrasion of the textile material customarily dyed with indigo dyes as a result of regular domestic washing. That disadvantage is, surprisingly, overcome with the method according to the invention. The method according to the invention is a method of achieving a permanent stone-wash effect, in which the textile fibre material, especially cellulosic fibre material, is dyed in the desired colour shade with naphthol dyes and then after-treated with a stone-wash finish.

The textile fibre material used in the method according to the invention is preferably cellulosic fibre material, especially cotton.

Very special preference is given to the use of denim in the method according to the invention. Denim is a cotton material with generally a blue-dyed warp and natural white weft. The warp is preferably dyed in the size (e.g. blue jeans).

The naphthol dyeings produced by the method according to the invention are produced on the fibres by combining (coupling) two soluble components, a naphtholate and a diazotised base. The base is either produced in the dyehouse itself or is purchased in the form of a stabilised diazotised fast-colour base, a so-called dyeing salt, from a dye manufacturer. There are a large number of combinations with which, for example, vivid yellow, orange and red shades can be achieved, which cannot be produced with the indigo dyes. Of course, all the blue shades can also be achieved with the naphthol dyes. The naphthol dyes are distinguished by good fastness properties, especially fastness to boiling. The dyeings achieved in accordance with the method according to the invention are further distinguished by excellent fastness to chlorine. It is to be emphasised that a broad spectrum of colour shades is opened up by the method according to the invention. In comparison with the indigo dyes, which subsequently bleed with every domestic wash and consequently do not allow a permanent effect, e.g. the stone-wash effect, to be obtained, the naphthol dyeings achieved using the method according to the invention do not exhibit any bleeding of the dye.

Furthermore, in comparison with the products dyed with indigo dyes, the dyeings, or dyed and made-up textiles, produced in accordance with the method according to the invention can better be provided with a finish, for example a finish comprising synthetic resins for imparting an easy-care finish to the fabric, and/or a Teflon® finish for imparting a water-, oil- and dirt-repellent finish to the fabric. A further finish which is of interest is finishing with emery machines in order to impart a velour leather character to the fabric, for example by means of emery rollers, that effect being achieved by grinding and accordingly splitting open the ends of the fibres.

Textile finishes as indicated above are described, for example, in EP-A-1 088 867, EP-A-1 225 269, EP-A-1 236 783, WO 86/02115, EP-A-0 325 918, EP-A-0 459 125, EP-A-0 491 248, EP-A-0 073 364.

When producing a naphthol dyeing, attention must be given to the stoichiometric calculation of the developer component (diazo component or fast-colour dyeing salt or fast-colour dye base) and the coupling component (substrate is impregnated with the coupling component), which couple together to form a depth of shade which is given in grams of fixed naphthol per kilogram of product (textile fibre material). The dissolution specifications for naphtholates and fast-colour dyeing salts have to be met precisely. Naphthols can be applied in the exhaust or pad process, the two-bath procedure, i.e. separate impregnation and developing, being the method customarily employed. In the exhaust process, the liquor ratio has to be adhered to precisely, because the proportion of the coupling component taken up by the fibres determines the depth of shade. In order to remove excess naphtholate after the impregnation, squeezing off, centrifuging off or rinsing are advantageously carried out. For denim articles it is usual to impregnate warp yarns in the size with naphthols. In order to develop the naphthol dye in the various procedures, a boiling bath comprising soap or special dispersants has proved advantageous.

The following may be mentioned as examples of naphtholates for impregnation, the C.I. number according to Colour Index, The Society of Dyers and Colourists, American Association of Textile Chemists and Colourists, Third Edition, Volume 4, 1971 also being given in addition to the formula for the purpose of characterisation:

C.I. 37505:

(1)

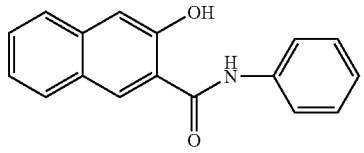

C.I. 37520:

(2)

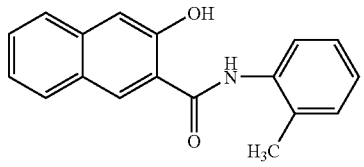

C.I. 37531:

(3)

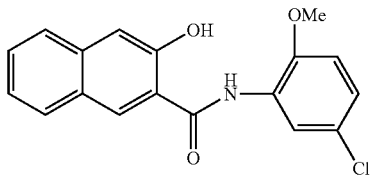

-continued

C.I. 37530:

(4)

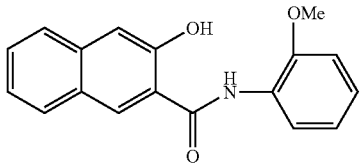

C.I. 37541:

(5)

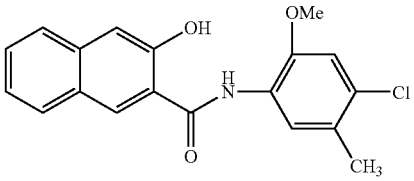

C.I. 37515:

(6)

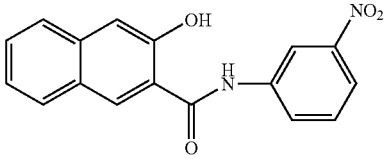

C.I. 37555:

(7)

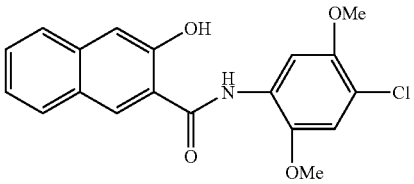

wherein —OMe is —$OHC_3$.

Further naphtholates or coupling components for impregnation which can be used in the method according to the invention are described, for example, in Colour Index, The Society of Dyers and Colourists, American Association of Textile Chemists and Colourists, Third Edition, Volume 4, 1971. Examples which may be mentioned include the azoic coupling components of the formulae having the C.I. numbers 37500, 37510, 37511, 37516, 37521, 37525, 37526, 37527, 37532, 37535, 37540, 37545, 37550, 37558, 37559, 37560, 37565, 37566, 37567, 37568, 37569, 37570, 37575, 37580, 37585, 37590, 37595, 37600, 37605, 37608, 37610, 37611, 37613, 37614, 37615, 37620 and 37625.

As diazotised fast-colour bases, or so-called dyeing salts, there come into consideration, for example, the following salts, the C.I. number according to Colour Index, The Society of Dyers and Colourists, American Association of Textile Chemists and Colourists, Third Edition, Volume 4, 1971 also being given in addition to the formula for the purpose of characterisation:

C.I. 37185:

(8)

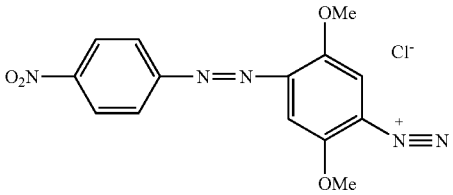

C.I. 37230:

(9)

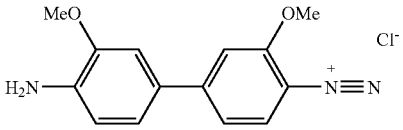

C.I. 37005:

(10)

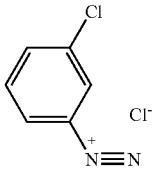

C.I. 37125:

(11)

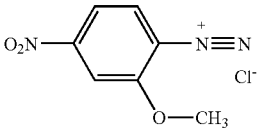

C.I. 37040:

(12)

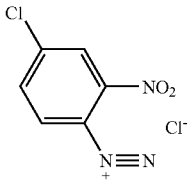

C.I. 37000:

(13)

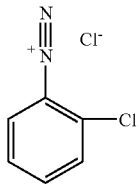

C.I. 37015:

(14)

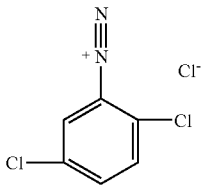

wherein —OMe is —$OHC_3$.

Further diazotised fast-colour bases or dyeing salts which can be used in the method according to the invention are described, for example, in Colour Index, The Society of Dyers and Colourists, American Association of Textile Chemists and Colourists, Third Edition, Volume 4, 1971. Examples which may be mentioned include the diazotised fast-colour bases or dyeing salts of the formulae having the C.I. numbers 37020, 37025, 37030, 37035, 37045, 37050, 37055, 37060, 37065, 37070, 37075, 37077, 37080, 37085, 37090, 37095, 37100, 37105, 37107, 37110, 37111, 37112, 37115, 37120, 37130, 37135, 37136, 37140, 37145, 37150, 37151,37155, 37160, 37161, 37165, 37170, 37175, 37180, 37190, 37195, 37200, 37205, 37210, 37215, 37220, 37225, 37235, 37240, 37245, 37250, 37255, 37260, 37265, 37270 and 37275.

In a preferred embodiment of the method according to the invention, the warp yarn is impregnated with a naphtholate and then interwoven with natural white cotton yarn, the colour is then developed on the fabric with the addition of a diazo salt, and the dyed fabric, advantageously after being made up, e.g. in the form of jeans, is after-treated with a stone-wash finish.

In a very especially preferred embodiment of the method according to the invention, the cotton warp yarn is impregnated with a naphtholate as the coupling component, it being possible for the impregnation advantageously to be carried out in the size, and then interwoven with natural white cotton yarn, the colour is then developed on the fabric with the addition of a diazo salt, the dyed fabric is made up, and the made-up article is then after-treated with a stone-wash finish.

In a very especially important procedure of the method according to the invention, the cotton warp yarn is impregnated with a naphtholate during the sizing treatment and is then interwoven with natural white cotton yarn, the colour is then developed on the fabric with the addition of a diazo salt, the dyed fabric is made up, and the made-up article is then after-treated with a stone-wash finish.

Sizing is carried out by processes known per se. The essence of sizing consists in passing the warp threads through a dispersion of, for example, swollen starch or another adhesive agent, e.g. glue or cellulose ether, so that the individual fibres of which the thread is composed are intimately bonded to one another and, especially, the fibre ends standing out from the surface of the yarn are bonded to the core of the thread. As a result, the thread acquires greater resistance to tearing and resistance to abrasion, so that the weaving process is less often subject to interruption owing to breakage of the warp thread. Sizing is comprehensively described in the literature, for example in Lehrbuch der Textilchemie by Hermann Rath, 2nd Edition 1963, Springer Verlag, Berlin, Göttingen, Heidelberg, pages 45 and 203 ff and in Lexikon für Textilveredlung by H. K. Rouette, Volume 3, 1995, Laumann-Verlag Dülmen, pages 1890 ff. Examples of sizing agents that come into consideration include water-soluble sizing agents, especially natural products based on starch or albumen, as well as sodium alginate. Also suitable are synthetic products, such as vinyl derivatives, especially polyvinyl alcohols and also polyvinyl alcohols partially hydrolysed by the $CH_3$—CO—O— group, for example, and polyacrylic derivatives as well as mixtures of the various sizing agents. There may be mentioned as a sizing formulation, for example, the dispersion of a starch, e.g. of amylose. The starch may also be modified, in which case the free OH groups are modified by $CH_3$—CO—, —$CH_2$—COOH or —$CH_2$—$CH_2$—OH. Typical commercially available sizing agents based on polyacrylic derivatives are, for example, Ciba® VICOL® WLV, Ciba® VICOL® WNR, size CA (BASF). A typical commercially available sizing agent based on polyvinyl alcohol is, for example, size UC-1 (BASF). Typical commercially available sizing agents based on starch or modified starch are, for example, SOLAMYL, AMITROLIT, Polyamyl, Extrasize CM. The sizing agents can be used together with a softener or a lubricant, for example Ciba® ALCOWAX® SB, Ciba® ALCOWAX® OG, Basasoft LB 394.

For the stone-wash finish it is especially preferred for the effect to be achieved by washing with stones or sand.

For the stone-wash finish it is likewise especially preferred for the effect to be achieved by enzymatic after-treatment.

The stone-wash after-treatment can be carried out in customary manner, as described, for example, in DE-C1-36 42 593, WO 90/02790, WO 95/09225 or WO 01/57173. For example, 60 kg of blue jeans material (denim) are washed at from 60 to 70° C. for 60 minutes in a commercially available washing machine together with 60 kg of aerated concrete stones, water and a commercially available washing agent. After washing, the material so treated is freed of the washing agent and the stones by rinsing. The dried material is markedly lighter in colour after the treatment and exhibits the desired "stone-wash" effect.

The colour washed out of and rubbed off the textile fibre material by the stone-wash finish can be treated by the renewed application of colour, especially by dyeing or spraying, so that different colour shades or colour progressions are obtained on the fibre material.

In a preferred embodiment of the further subsequent application of colour, the colour shade achieved by the application of colour is different from the base colour obtained with the naphthol dye.

The invention relates also to the use of naphthol dyes in producing a denim finish for achieving the stone-wash-finish effect.

There come into consideration as textile fibre materials especially hydroxyl-group-containing fibre materials. Preference is given to cellulosic fibre materials which consist wholly or partially of cellulose. Examples are natural fibre materials, such as cotton, linen or hemp, and regenerated fibre materials, e.g. viscose and also lyocell. Special preference is given to viscose or especially cotton or very especially denim. Other fibre materials which may be mentioned are wool, silk, polyamide and aramid. The mentioned fibre materials are preferably in yarn form.

The dyeings obtained by the method according to the invention have very good fastness to light and good fastness-to-wetting properties, such as fastness to washing, water, seawater, crossdyeing and perspiration. Special mention is to be made of the very good fastness-to-wetting properties, such as fastness to boiling, and the excellent fastness to chlorine.

The Examples which follow are intended to illustrate the invention but do not limit the invention to the specific Examples.

EXAMPLE 1

Production of a dark-blue naphthanilide dyeing on 100% of a cotton warp yarn and subsequent interweaving with natural white cotton weft yarn.

A solution for impregnation of the warp yarn is prepared as follows:

Solution 1: The following are dissolved in 27 liters of water at 75° C.:

20 g/l of naphthanilide RC of formula (1)

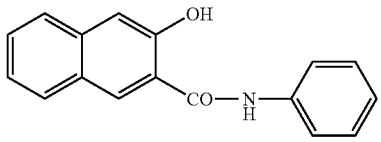

C.I. 37505

10 g/l of a protective colloid, e.g. IGRASOL® DN 0.3 g/l of a deaerating agent, e.g. ALBATEX® FFC 0.2 g/l of a wetting agent, e.g. CIBAFLOW® PAD.

The solution is made up to 40 liters.

A sizing formulation, solution 2, is prepared by dissolving 133.4 g/l of a modified starch, e.g. Polamyl or Extrasize CM 10.0 g/l of a softener, e.g. Basosoft LB 394 in 45 liters of water at 90° C. and is then made up to 60 liters.

Solution 1 and solution 2 are mixed and fed to the sizing machine. Impregnation is carried out at about 92° C., the speed is 35 m/minute, the liquor pick-up is about 100%. After drying, the moisture content is about 8% by weight and the dry content of the size in the yarn is 5.6% by weight.

The impregnated cotton warp yarn is then interwoven with natural white cotton weft yarn. A total of 3750 m of cotton warp yarn are processed, which results in the production of 2900 m of fabric. The fabric obtained has a weight per meter of 636 g at a width of 1.5 m.

A dark-blue shade on 700 m of the fabric is developed as follows:

100 g/l of diazo fast-colour blue VBN of the formula

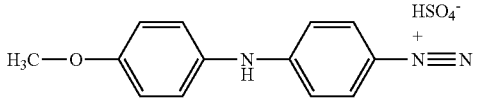

C.I. 37255 and 6.5 g/l of a dispersant, e.g. IRGASOL® NA, are dissolved while cold in 40 liters of water. Impregnation is carried out in a padding machine with a liquor pick-up of about 70% and a speed of 30 m/minute. After rinsing and soaping of the developed dyeing in a continuous washing installation and subsequent drying of the dyed fabric, a dark-blue dyeing is obtained.

The dyed fabric so obtained is made up into jeans (further possibilities are making up into articles of clothing such as e.g. shirts or jackets).

The "stone-wash effect" is then imparted to the dyed and made-up article of clothing in a washing process, as follows:

In a commercially available washing machine, 10 kg of the jeans (denim) dyed blue in the manner indicated above are washed at from 60 to 70° C. for 60 minutes together with 10 kg of aerated concrete stones, 40 liters of water and a commercially available washing agent. The jeans so treated are then rinsed in order to remove the washing agent and the stones, and then dried. The dried jeans are markedly lighter in colour after the treatment and exhibit the desired "stone-wash" effect.

The effect is maintained unchanged even after several domestic washes, because no further dye bleeds from the jeans.

If the procedure of Example 1 is followed but, in an otherwise identical procedure, there is used instead of naphthanilide RC an equimolar amount of one of the coupling components listed in Table 1, column 2, together with one of the diazo fast-colour bases listed in Table 1, column 3, in an equimolar amount, textiles dyed in the given shade (see column 4) are obtained which exhibit the desired stone-wash effect and which do not bleed further in subsequent washes and which exhibit excellent fastness properties.

TABLE 1

| Example | Coupling component or naphtholate | Diazo fast-colour base or dyeing salt | Shade on cotton |
|---|---|---|---|
| 2 | 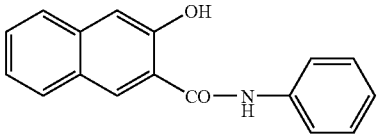 | 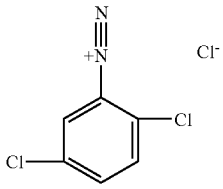 | scarlet |
| 3 | 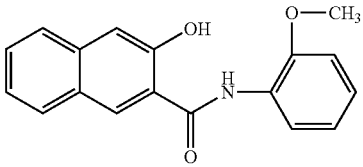 | 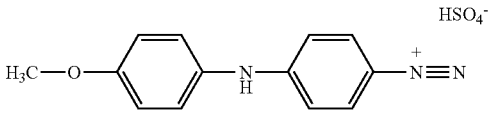 | blue |

TABLE 1-continued
| Example | Coupling component or naphtholate | Diazo fast-colour base or dyeing salt | Shade on cotton |
|---|---|---|---|
| 4 | 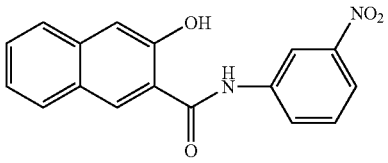 | 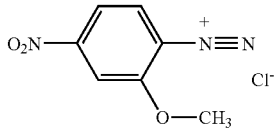 | claret |
| 5 | 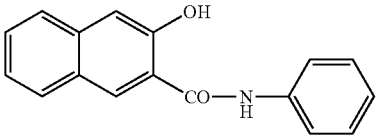 | 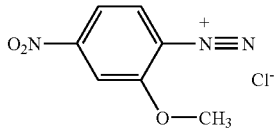 | red |
| 6 | 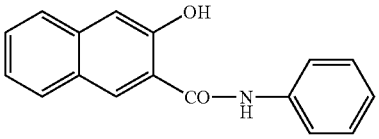 | 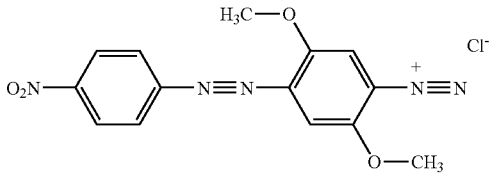 | black |
| 7 | 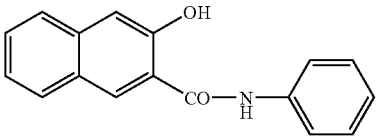 | 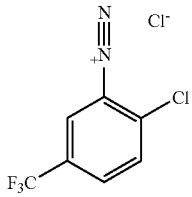 | orange |
| 8 | 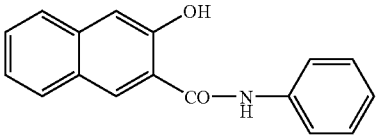 | 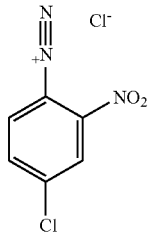 | red |
| 9 | 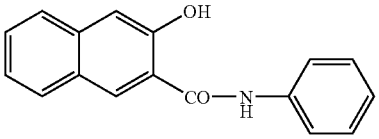 | 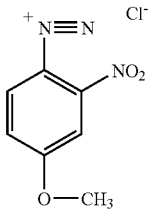 | claret |
| 10 | 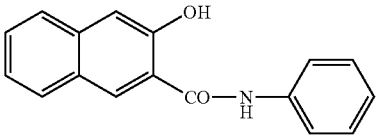 | 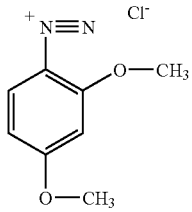 | red |
| 11 | 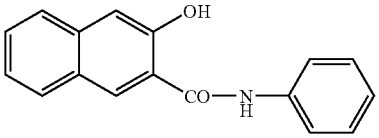 | 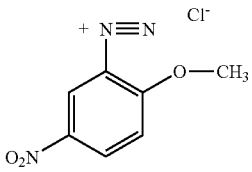 | scarlet |

TABLE 1-continued

| Example | Coupling component or naphtholate | Diazo fast-colour base or dyeing salt | Shade on cotton |
|---|---|---|---|
| 12 | 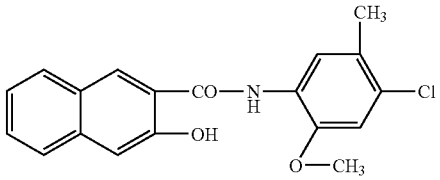 | 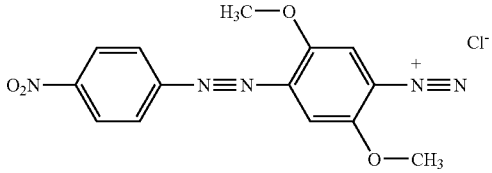 | black |
| 13 | 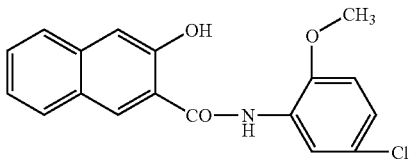 | 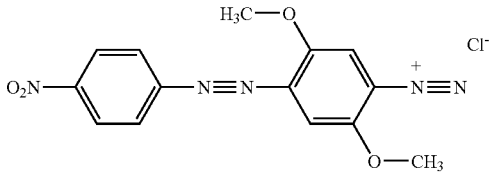 | black |

What is claimed is:

1. A method of achieving a permanent stone-wash effect on a denim fabric prepared by interweaving a cotton warp yarn and a natural white cotton weft yarn fibre material, in which the cotton warp yarn is impregnated with a naphtholate during a sizing treatment and then interwoven with the natural white cotton weft yarn, a colour is then developed on the fabric with the addition of a diazo salt, the dyed fabric is made up and the made up article is then after-treated with a stone-wash finish.

2. A method according to claim 1, in which the stone-wash finish is achieved during washing with stones or sand.

3. A method according to claim 1, in which the stone-wash finish is produced by enzymatic after-treatment.

4. A method according to claim 1, in which, following the stone-wash finish, a further dye is applied to the dyed and after-treated fabric.

5. A method according to claim 4, in which the application of the further dye is effected by spraying.

6. A method according to claim 4, in which the application of colour yields a the further dye shade that is different from the base colour obtained with the naphtholate.

* * * * *